US006003868A

United States Patent [19]

Unsicker

[11] Patent Number: 6,003,868

[45] Date of Patent: Dec. 21, 1999

[54] GAME BALL

[76] Inventor: Andreas Unsicker, Yorkstrasse 8, D-94049 Regensburg, Germany

[21] Appl. No.: 09/117,530

[22] PCT Filed: Feb. 4, 1997

[86] PCT No.: PCT/DE97/00211

§ 371 Date: Nov. 18, 1998

§ 102(e) Date: Nov. 18, 1998

[87] PCT Pub. No.: WO97/28865

PCT Pub. Date: Aug. 14, 1997

[30] Foreign Application Priority Data

Feb. 6, 1996 [DE] Germany ..... 196 04 140
Sep. 10, 1996 [DE] Germany ..... 296 15 715

[51] Int. Cl.[6] ..... A63F 9/08

[52] U.S. Cl. ..... 273/153 S

[58] Field of Search ..... 273/153 R, 153 S, 273/156

[56] References Cited

U.S. PATENT DOCUMENTS 4,452,454 5/1984 Greene ..... 273/153 S
4,553,754 11/1985 Wiggs et al. ..... 273/153 S

FOREIGN PATENT DOCUMENTS 2549381 1/1985 France .
82 02 370 9/1982 Germany .
31 38 050 A1 7/1983 Germany .
1733028 5/1992 U.S.S.R. ..... 273/153 S
2206053 12/1988 United Kingdom ..... 273/153 S

*Primary Examiner*—Steven Wong
*Attorney, Agent, or Firm*—Hoffman, Wasson & Gitler, P.C.

[57] ABSTRACT

A game ball with at least two axially symmetrical portions, rotatable with respect to each other, is provided with two diametrically opposite cones having a common center axis and being rotatable together around the center axis at their facing peaks. A ring-shaped central portion supplements the two cones to a ball and is rotatable relative to the two cones around the center axis. A guide groove extends in one main plane of the ball around the periphery of the ball. The groove is formed at the outer surfaces of the two spherical calottes of the cone and the central portion. Operating elements, in a peripheral direction are arranged in a row, are positioned in the main plane of the ball, and are guided within the guide groove.

11 Claims, 6 Drawing Sheets

Fig. 3
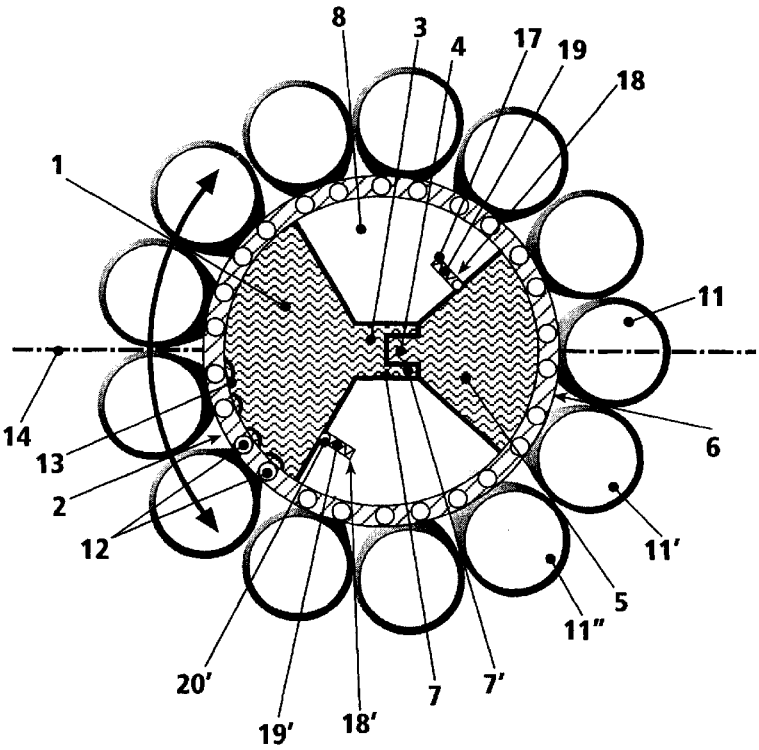
Fig. 5
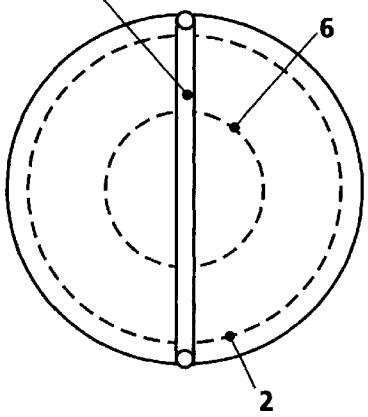
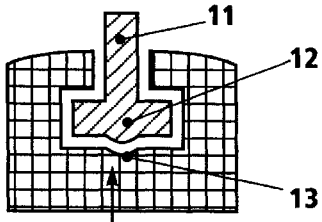
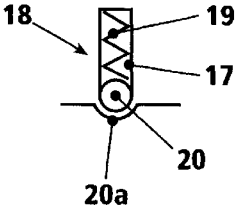
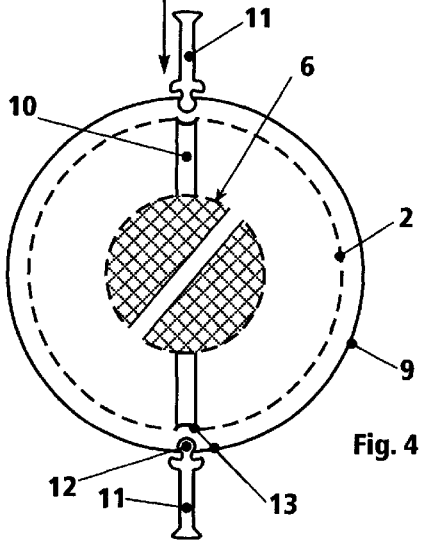
Fig. 4
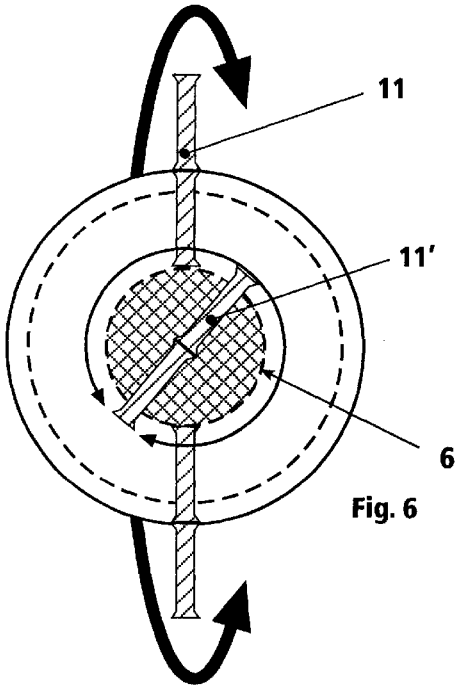
Fig. 6

Fig. 12
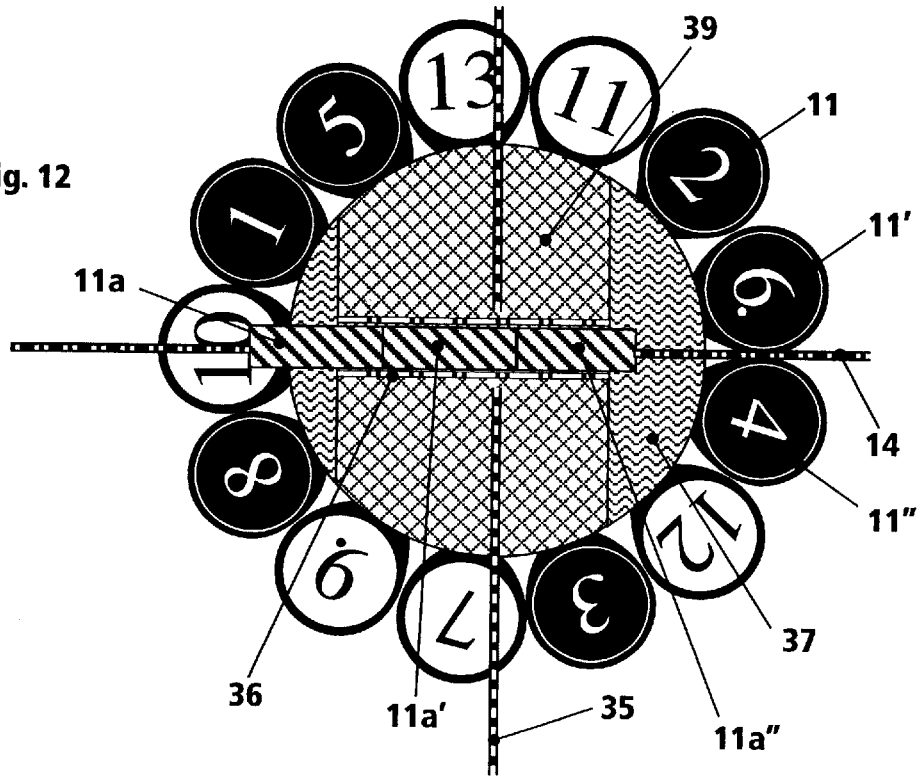
Fig. 11
Fig. 13
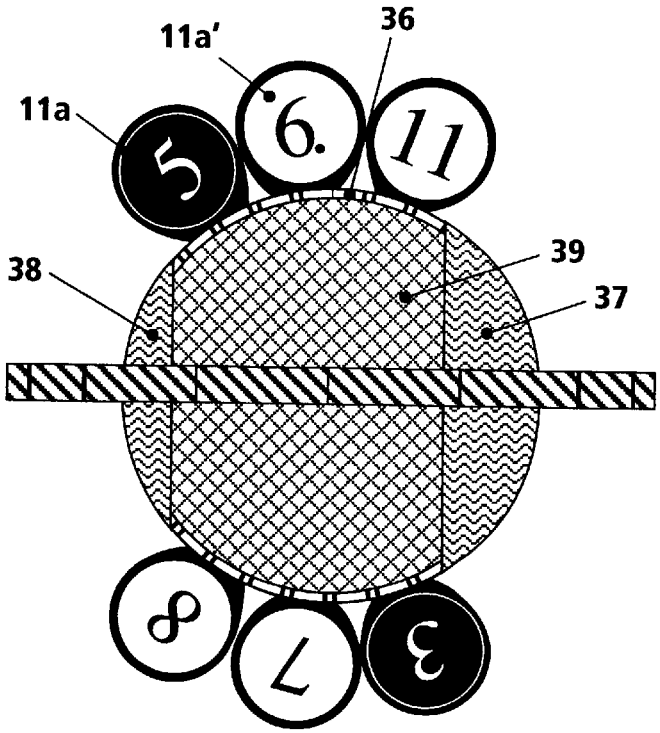

GAME BALL

FIELD OF THE INVENTION

This invention refers to a game ball consisting of at least two portions which are rotatable relative to each other and are axially symmetrical.

BACKGROUND OF THE INVENTION

Game cubes such as "Rubik Cube" have been extensively in use. The cubes consist of elements which are rotatable relative to each other in one plane, and can be rotated around two axes extending perpendicular to each other.

Furthermore, from G 82 02 370.0 (U1), a ball-like game for testing one's patience is disclosed. The body is formed of at least two portions movable relative to each other, which are in contact with each other along a common separating line, and which, at the outer surface of the portions, are provided with paths connecting two points separated from each other along the separating line so that relative movement of the members along the separating line connects the individual paths into tracks of different design step-by-step. Movable bead elements differing from each other are arranged within the paths or tracks.

U.S. Pat. No. 4,452,454 teaches a game ball which is known in the art. The game ball comprises two diametrically opposite ball calottes and a disk which supplements the two calottes into a ball and receives the two ball calottes. The two calottes are arranged independent from each other and rotatable relative to the disk. On the ball surface movable game elements are arranged like bands in three planes orthogonal to each other. The game elements are part of the surface of the game ball so that when playing the game the player merely is able to view a very limited number of game elements at a glance.

It is an object of the subject invention to propose a game ball which allows the user to play an extraordinary large number of variations and possibilities, and offers a high level of difficulty, and the structural design of which is relatively simple.

Furthermore, it is an object of the invention to arrange the operating elements on the surface of the game ball so that it can be seen by the player during playing the game in its entirety and so that the player is able to check the game situation any time at a glance.

SUMMARY OF THE INVENTION

The game ball is characterized by two cones arranged diametrically opposite to each other, having a common center axis and being rotatable around their center axis, a ring-shaped center portion, supplementing the two cones to a ball and being rotatable around the center axis relative to the two cones, a peripheral guide groove extending in one main plane of the ball. The groove is formed at the outer surfaces of the two calottes of the cone and the center portion. Operating elements join each other in a row in the peripheral direction, arranged in the main plane of the ball and guided within the guide groove. The operating elements preferably are formed as disks with guiding means, such as guiding shoes movable within the guide groove in a peripheral direction.

Basically, the invention is designed in such a manner that the two cones according to a first variation are fixed and stationary to each other and cannot be rotated relative to each other, and in a second variation are connected with each other but are rotatable relative to each other.

According to an embodiment the invention proposes to provide within the ring-shaped center two further cone elements, the center axes of which are inclined, preferably perpendicular to the center main axis, and are rotatably driven around their center axis by one of the cones. The surfaces of the calottes of the cones form part of the center portion occupied by the cone elements. An integral number of operating elements are associated with the calotte surface of such cone. In this manner the level of difficulty is increased. The two cone elements are drivingly connected with one of the two cones in such a manner that they are coupled with each other by means of gear wheels, friction wheels or the like so that when rotating one of the cone elements the associated cone and, by means of the one cone element, the other cone element is rotated.

Another embodiment of the invention is provided so that the ring-like guide groove, arranged in the center plane of the ball and receiving the operating elements, is formed as a double groove (or alternatively as a single groove). Each of the two grooves or the individual groove receives a ring of operating elements. In this manner the two rings of the operating elements are rotatable relative to each other in parallel planes. The operating elements of the two ring assemblies can be made of different colors, or can be provided with different numbers or markings, and the like. Preferably the operating elements in both double grooves are identical which means that they are of the same size and of the same numbering, but, of different colors. Because the rings of operating elements are arranged in two planes, one closely above the other, rotating one ring of operating elements in view of the other ring is difficult to manipulate if the peripheral surface of the operating elements is small. Therefore, it is proposed to design the operating elements radially outwardly with increasing thickness so that the peripheral surface of the operating elements is substantially increased. In addition (or alternatively) holding recesses, handles, pins or the like can be provided as operating elements at the peripheral rim.

According to a further embodiment of this invention the ball is provided with a second guide groove in a plane perpendicular to the plane of the guide groove. The second guide groove is exclusively formed within the center portion, and receives further operating elements similar to those of the first guide groove so that two different planes of operating elements are provided on the center portion. When rotating the two cones or the ring-shaped center portion, the operating elements of the two orthogonal planes receiving the guide grooves can be merged and combined with each other.

According to another embodiment of the invention two rings of operating elements, arranged in two planes preferably extending orthogonal to each other, are provided on the entire ball surface. When rotating the two cones or the center portion forming a ball zone the operating elements of the two planes are merged and combined with each other. This requires that two adjacent operating elements of a guide groove have a sufficiently large distance from each other so that eh operating elements of the other guide groove arranged perpendicular to the first operating elements can be passed between two adjacent operating elements. Preferably, the operating elements are formed as thin disks.

The game ball according to the invention has the important advantage in that the entire game elements and accordingly the entire game situation according to FIGS. 1–10 (and with FIGS. 11–15 the major part) can be registered by the player straightaway and at a glance, because they are all within sight of the player, that the combinations available to the player are extremely large, and that a plurality of game variations are available according to which the player is able to arrange the game elements as they are provided with different numbers (or markings) as well as different colors. In this manner, the player is in a position with one and the same game ball to manipulate at a first level of difficulty the game elements playing according to the color, at a second level of difficulty playing according to a predetermined sequence of numbers, and in a third level of difficulty playing according to color and numbers. In this way, the player is in a position to play the game with an extremely high number of possibilities and variations, and therefore, to get manifold varieties in the game. The structural design of this game ball is rather simple and easy to make.

Instead of markings formed as numbers the operating element can be designed as letters or other characterizing markings, i.e., picture elements or the like.

BRIEF DESCRIPTION OF THE DRAWINGS

The construction designed to carry out the invention will be described by reference to the drawings based on various embodiments.

FIG. 3 is a further cross-sectional view,

FIG. 4 is a lateral in section with an operating element,

FIG. 5 is a lateral view in sectional view without operating elements,

FIG. 6 is a lateral view of the game ball with operating elements, rotated 90° in view of FIG. 3, FIG. 12 shows a fourth embodiment of the invention in plan view, FIG. 13 is the embodiment according to FIG. 12 in a different view turned around 90°.

DETAILED DESCRIPTION OF THE INVENTION

Figure 1:
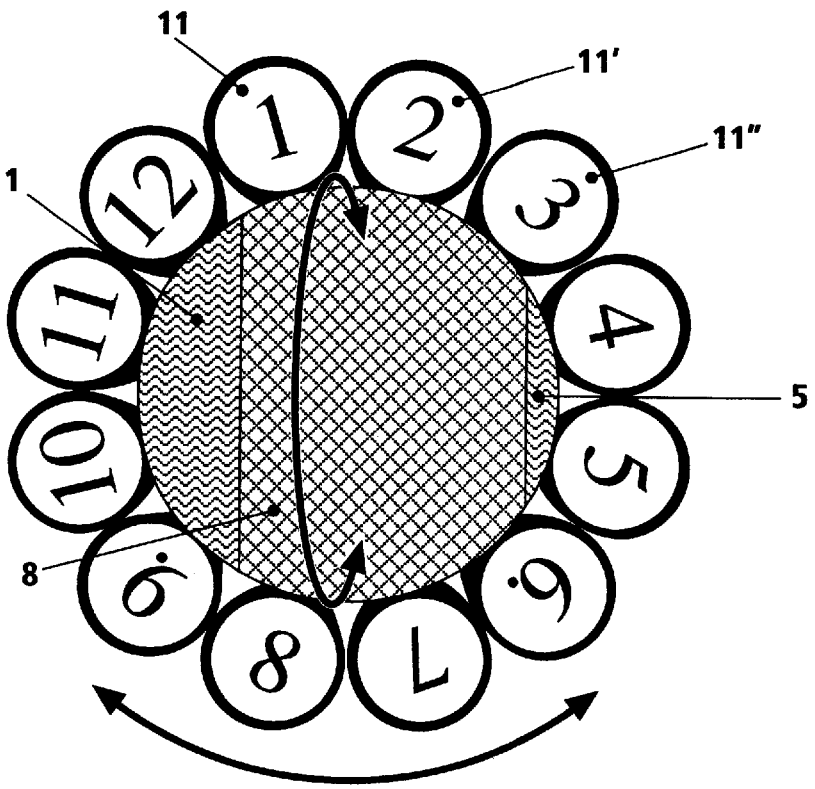
FIG. 1 shows a plan view of a first embodiment of a game ball according to the invention.
Figure 2:
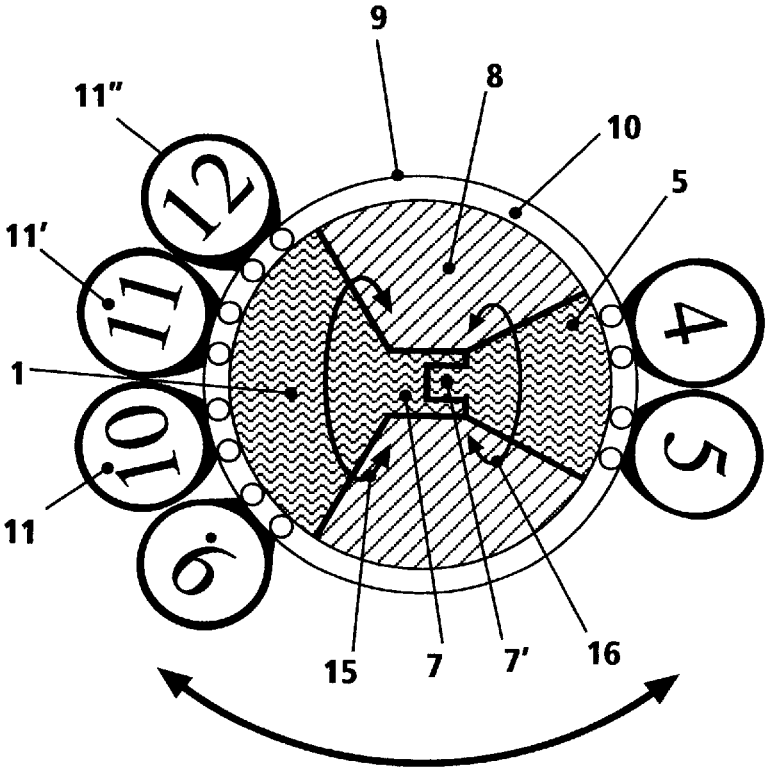
FIG. 2 is a cross-section in the drawing plane of FIG. 1.

The game ball comprises a cone 1 with an aperture angle of approximately 120° and a calotte area 2, the cone peak 3 of which is cylindrically formed and has a recess 4, and a cone 5 with an aperture angle of approximately 60° and a calotte area 6, as well as a tubelike cone peak 7, which together with the cylindrical extension of the cone peak 3 engages, the recess 4 by means of an extension 7'. The two cones 1 and 5 are supplemented by a ring-shaped center portion 8 to a ball. The center portion 8 has a peripheral surface 9 with a peripherally extending guide groove 10, which extends across the entire periphery of the ball and also across the calotte surfaces 2 and 6. The guide groove 10 receives operating elements 11 being formed, for example, as disks which at their bottom end are provided with guide means 12, such as guide shoes 12. The guide shows are movably guided within groove 10, and are lockedly positioned in recesses 13 in a defined manner. Instead of the shown two separate guide means 12 per operating element 11, 11', 11", etc. an individual guide shoe can be provided. The two cones 1 and 5 are rotatable in the rotational directions 15 and 16 around the main axis of the game ball 14.

One of the inner surfaces of the central portion 8 is provided with a recess or bore 17, 17', in which a spring 19, 19' is arranged which is associated to latching means 18, 18' on the cones 1 and 5. Spring 19, 19' exerts a pressure onto a ball-like latch element 20, 20' and positions the latch element within a recess 20*a*. The recesses are used as positioning means or latching means for playing the game.

The calotte surfaces 2 and 6 of the cones 1 and 5, which for example extend across a peripheral angle between 150° and 30°, receive an integral number of operating elements resp. disks 11, 11', 11"etc. For example, the calotte surface 2 receives four disks and the calotte surface 6 receives two disks. With this special embodiment three disks are arranged within the two peripheral grooves of the center portion so that altogether twelve disks resp. Operating elements join each other in the peripheral direction.

The two cones 1 and 5 preferably are fixedly and not releasably connected with each other but are rotatable relative to each other, such as by gluing of an extension 7' within the recess 4. However, this connection also can be made by locking means, for example, by pressing the two peaks of the cones against each other and by urging an arrow-like locking element into a corresponding mounting support so that in view of the spreading effect of the arrow-type element, a movement in the opposite direction will be prevented.

The disks resp. operating elements 11, 11', 11", etc. are provided with numbers or similar markings on their surface. The background of the disk is made in color, so groups of disks can be provided with the same color. Within the drawings the arrangement of the disks is chosen so that twelve disks are provided in a ring-like row. The invention is not restricted to this number of disks (the total number can be smaller or larger). With an uneven number of, for example, thirteen disks the game can be played with even more variations.

Figure 7:
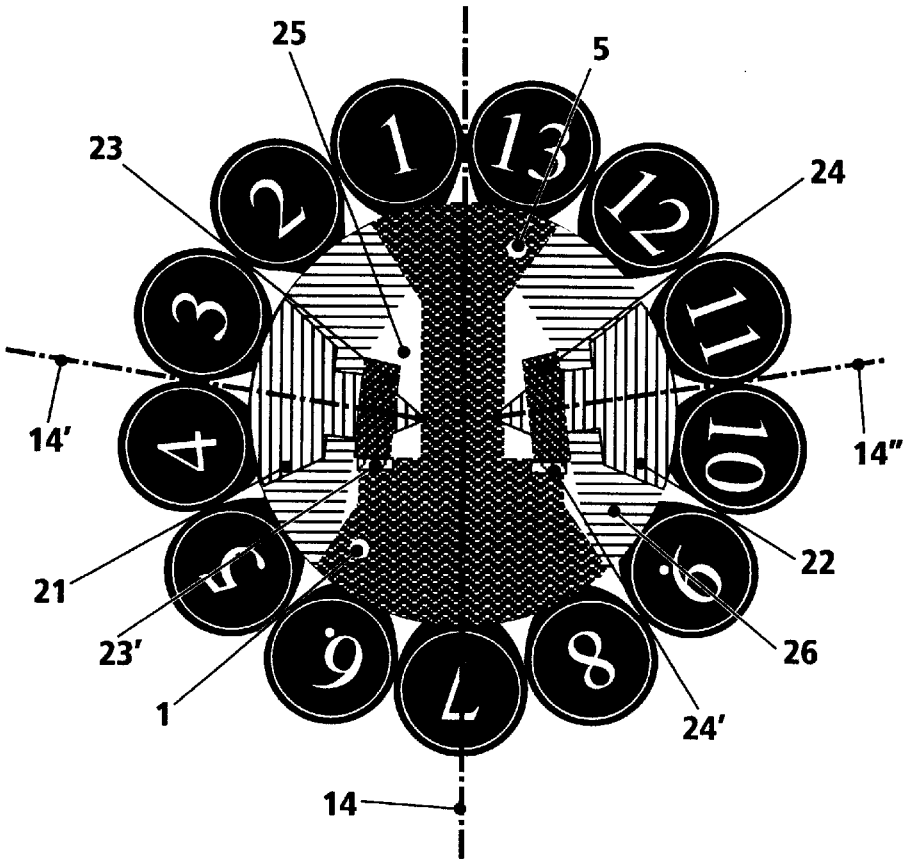
FIG. 7 shows a second embodiment of the invention in cross-section.
Figure 8:
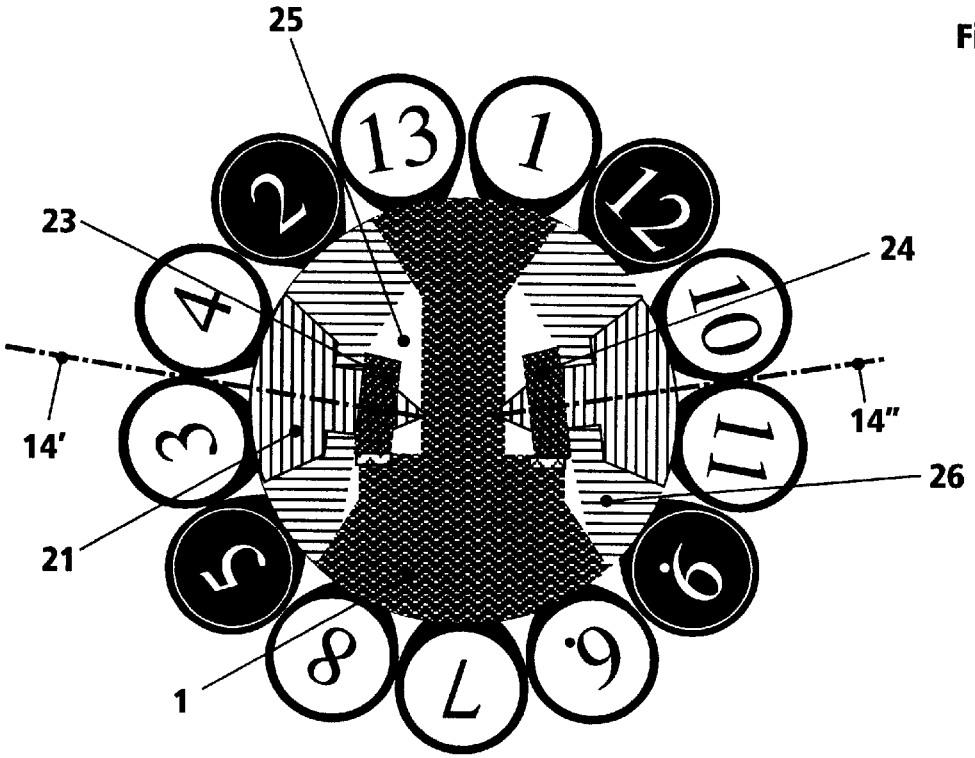
FIG. 8 is an embodiment according to FIG. 7 in an altered position.

According to the embodiments of FIGS. 7 and 8 in addition to the two cones 1 and 5 within the ring-shaped center portion two further cone elements 21, 22 with central axis 14' and 14" each are arranged diametrically opposite to each other. They are connected with cone 1 so that if the latter will be rotated, gear wheels 23, 24 or corresponding driving transfer elements are driven, which engage the teeth elements 23', 24' or the like of cone 1 similar to a toothed rim. With this embodiment the cone elements 21, 22 each have a peripheral extension which receives two operating elements (disks). Cone 5 has a peripheral extension which receives three operating elements. The peripheral sections which separate the individual cones from each other and form the central portions 25, 26, each have a peripheral extension which corresponding with an operating element so that thirteen operating elements resp. disks are provided which are equally distributed over the periphery along the guide groove 10. The arrangement according to FIGS. 7 and 8 results in a more complicated operation mode, and the level of difficulty is increased by the fact that when rotating cone 1 and the associated operating elements the cone elements 21, 22*b* and their associated disks are automatically rotated, too.

Figure 9:
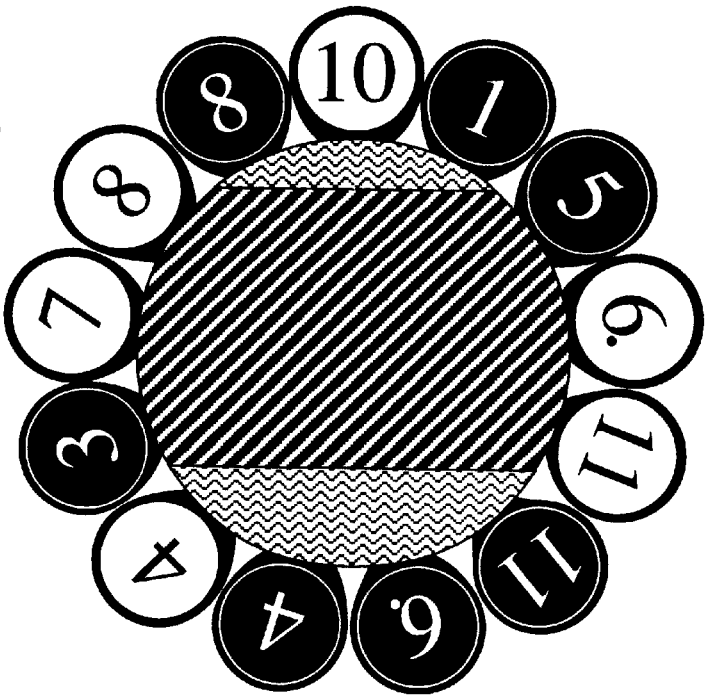
FIG. 9 shows a third embodiment of the invention in plan view.
Figure 11:
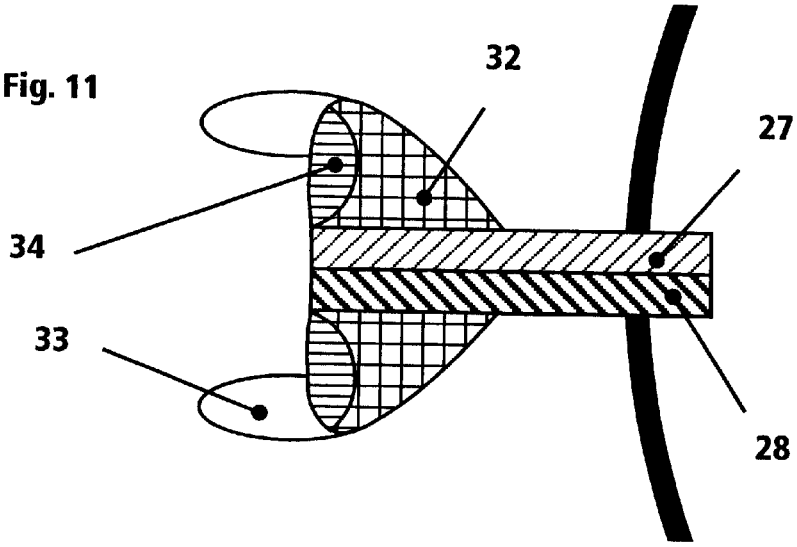
FIG. 11 is a cross-section through an operating element according to FIG. 10.
Figure 10:
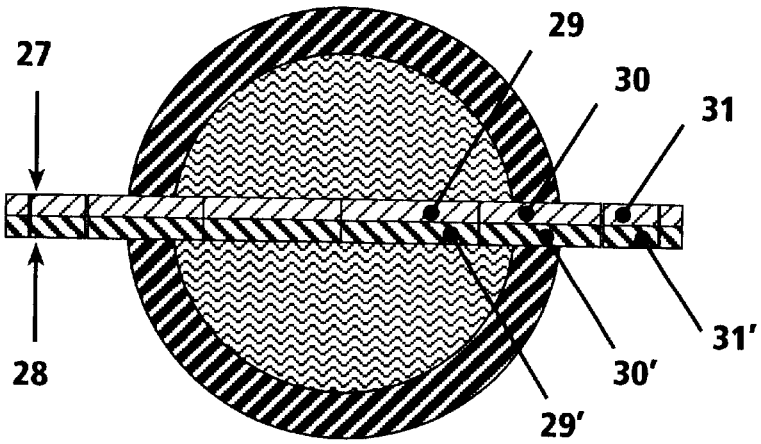
FIG. 10 is an embodiment according to FIG. 9 in a view turned around 90° in view of the picture in FIG. 9.

The embodiment shown in FIGS. 9 and 10 is formed in design and structure according to the game ball of FIGS. 1–6. The main difference besides the different number of operating elements (thirteen instead of twelve) is that the ring of operating elements and the guide groove are provided twice. This means that within two parallel planes, arranged one above the other, two series 27, 28 of equal operating elements are provided which are arranged independent from each other and relative to each other within the two parallel planes and can be rotated away from these planes. The operating elements 29, 30, 31, etc.; 29', 30', 31', etc. shown in FIG. 11 are formed with increasing thickness in a radially outwardly extending direction, or are provided with additional operating elements in the form of trunnions 33 or gripping recesses 34 in order to have a larger gripping area for better handling.

The embodiment according to FIGS. 12 and 13 is provided with an additional rotational plane 35 extending perpendicular to the plane of rotation 14 (FIG. 2), so that the plurality of adjustabilities will be considerably increased. Basically, this means that two game balls according to FIGS. 1–6 or alternatively 7 and 8, or 9 and 10 are combined into a single ball. Within a central plane of the game ball perpendicular to the plane 14 the operating elements 11, 11', 11", etc. and the guide groove 10 receiving the elements are provided. Within the central portion 39 an additional guide groove 36 is formed further operating elements 11*a*, 11*a'*, 11*a"*, etc. (in the example of FIG. 12 and 13 six elements) are arranged which can be combined with the operating elements 11, 11', 11", etc. according FIG. 2 by being rotated within the plane of the guide groove 36 and by turning the individual ball sections 37, 38, 39.

Figure 14:
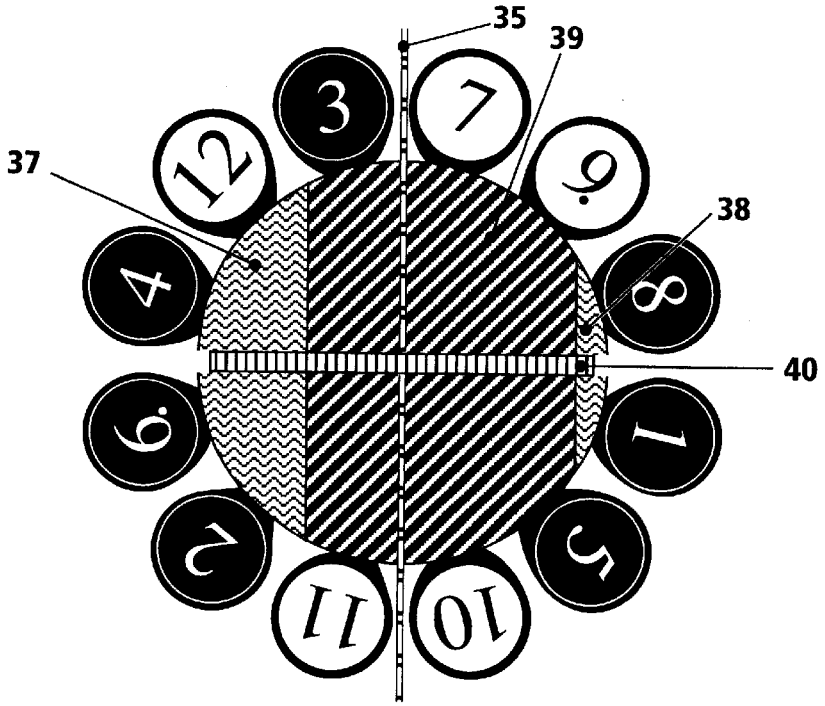
FIG. 14 shows a fifth embodiment of the invention with a second through-going guide groove without any operating elements, in plan view.
Figure 15:
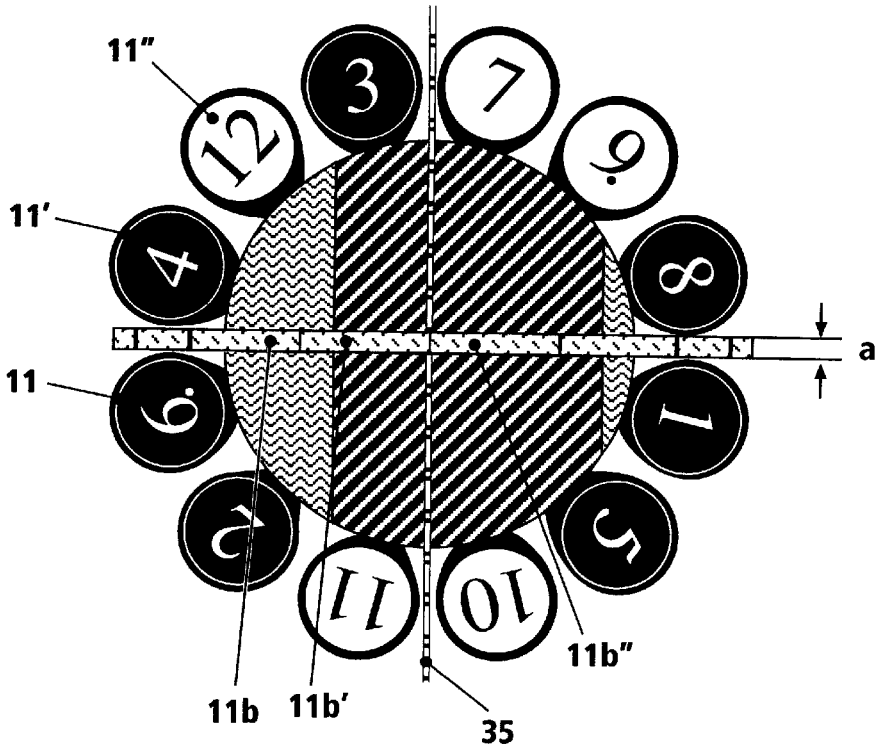
FIG. 15 shows the system according to FIG. 14 with operating elements arranged in a second guide groove.

The embodiment of a game ball according to FIGS. 14 and 15 is similar to the embodiment of FIGS. 12 and 13, but has an additional rotation plane 35 perpendicular to the rotation plane 14 (drawing plane). Within the rotation plane 35 a peripheral ring-shaped groove 40 is provided which extends across the entire ball periphery. Corresponding operating elements 11*b*, 11*b'*, 11*b"*, etc. are arranged in the groove 40 and designed and are positioned analog to the operating elements 11, 11', 11", etc. The operating elements 11, 11', 11", etc. have a small distance from each other which is chosen so that the operating elements 11*b*, 11*b'*, 11*b"*, etc. within the guide groove 40 can pass between two adjacent operating elements 11, 11', 11", etc. when rotating the ball elements.

I claim:

1. A game ball, comprising:

a first cone having a center axis and a peak, a second cone having a center axis and a peak the center axis of the first cone aligned with the center axis of the second cone, a ring-shaped center portion, the ring-shaped center portion rotatable about the center axis of the cones, a first peripheral guide groove formed in the outer surface of the two cones and ring-shaped center portion, operating elements movably retained in the first peripheral guide groove.

2. The game ball of claim 1, wherein the peaks of the first cone and second cone are provided with extensions that are locked to one another.

3. The game ball of claim 1, further comprising:

a lock on the center portion, a recess of the first cone, the lock engaging the recess.

4. The game ball of claim 3, wherein the lock on the center portion is a spring-biased ball.

5. The game ball of claim 1, wherein the operating elements are disks.

6. The game ball of claim 1, wherein a second guide groove is formed in the outer surface of the game ball.

7. The game ball of claim 6, wherein the second guide groove is parallel to the first guide groove.

8. The game ball of claim 6, wherein the second guide groove is perpendicular to the first guide groove.

9. The game ball of claim 1, further comprising:

a third cone rotatably retained in the center portion, the third cone having a center axis which extends at an angle to the center axis of the first cone, a fourth cone rotatably retained in the center portion.

10. The game ball of claim 9, further comprising drivers connecting the third cone and fourth cone to the first cone.

11. The game ball of claim 10, wherein the drivers are gear wheels.

* * * * *